US010099764B2

(12) United States Patent
Huan

(10) Patent No.: US 10,099,764 B2
(45) Date of Patent: Oct. 16, 2018

(54) SIDE-INTAKE PISTON JET PROPULSOR

(71) Applicant: Jianchun (James C.) Huan, Chantilly, VA (US)

(72) Inventor: Jianchun Huan, Houston, TX (US)

( * ) Notice: Subject to any disclaimer, the term of this patent is extended or adjusted under 35 U.S.C. 154(b) by 12 days.

(21) Appl. No.: 14/953,421

(22) PCT Filed: Mar. 8, 2013

(86) PCT No.: PCT/US2013/029853

§ 371 (c)(1),
(2) Date: Nov. 30, 2015

(87) PCT Pub. No.: WO2014/065855

PCT Pub. Date: May 1, 2014

(65) Prior Publication Data

US 2016/0280350 A1 Sep. 29, 2016

Related U.S. Application Data

(60) Provisional application No. 61/716,773, filed on Oct. 22, 2012.

(51) Int. Cl.

| | |
|---|---|
| ***B63H 11/06*** | (2006.01) |
| ***F04B 19/04*** | (2006.01) |
| ***F04B 19/22*** | (2006.01) |
| ***F04B 1/04*** | (2006.01) |
| ***F04B 23/10*** | (2006.01) |

(Continued)

(52) U.S. Cl.

CPC ..... *B63H 11/06* (2013.01); *F04B 1/0408* (2013.01); *F04B 1/0421* (2013.01); *F04B 1/0452* (2013.01); *F04B 19/04* (2013.01); *F04B 19/22* (2013.01); *F04B 23/106* (2013.01); *F04F 5/24* (2013.01); *F04F 5/46* (2013.01); *F04F 5/54* (2013.01); *B63H 1/32* (2013.01)

(58) Field of Classification Search

CPC ..... B63H 1/32; B63H 11/06; F04B 1/0421
See application file for complete search history.

(56) References Cited

U.S. PATENT DOCUMENTS 2,203,010 A * 6/1940 Diamand ..... B63H 11/12 60/221
3,677,217 A * 7/1972 Takimoto ..... B63H 1/32 416/79

(Continued)

FOREIGN PATENT DOCUMENTS

GB 190809860 A * 5/1909 ..... B63H 11/06

*Primary Examiner* — Andrew Polay

(57) ABSTRACT

A Side-Intake piston water jet propulsor for marine vehicles employs a concept of Side-Intake of water and generates thrust through piston's reciprocating motion in cylinder. The concept of Side-Intake makes intake openings on the side and near the discharging end of the cylinder wall to achieve that the piston separates the cylinder into a dry and a wet compartment during its movement. The dry compartment is kept at atmospheric or ambient pressure. As a result, the piston confronts air or ambient pressure instead of water during its recovering stroke for water intake. From hydrodynamics point of view, this characteristic of piston's recovering stroke through air achieves the same function as an oarsman recovering his oar through air. However, said propulsor achieves that under water or a vessel's water line.

2 Claims, 5 Drawing Sheets

(51) Int. Cl.

| | |
|---|---|
| ***F04F 5/24*** | (2006.01) |
| ***F04F 5/46*** | (2006.01) |
| ***F04F 5/54*** | (2006.01) |
| *B63H 1/32* | (2006.01) |

(56) References Cited

U.S. PATENT DOCUMENTS 3,850,195 A * 11/1974 Olsson ..... F16K 17/34
137/493
3,971,330 A * 7/1976 French ..... B63H 11/06
440/23

* cited by examiner (a) intake process (b) discharge process

SIDE-INTAKE PISTON JET PROPULSOR

FIELD OF THE INVENTION

Propellers, impeller-driven water jet propulsor and piston or reciprocating water jet propulsors for marine vehicles, Water pumps.

BACKGROUND OF THE INVENTION

For marine vehicle propulsion, propellers or impeller-driven water jets are mostly being used. The principle to generate thrust in water is to use some mechanism to build up water kinetic energy from the water velocity in line with the thrust axis. Marine propellers or marine impeller-driven water jets all depend on the spin of blades in water to build up the water kinetic energy. Because of the spin of blades in water, the kinetic energy built up in water is contributed not only from the water velocity in the thrust-producing axis but also from the water rotational velocity about the spinning axis. The kinetic energy from the rotational velocity of water doesn't contribute to the generation of thrust and therefore it is an energy waste. This principally-embedded energy waste leads to the fact that such propulsors could hardly reach close to the ideal efficiency of propulsor. The highly rotational water kinetic energy not only brings down the efficiency of the propulsor but also the sources of blade surface cavitations and the helical vortices in the propulsor flow wake that generate water noises. Further more, the increase of water velocity in the thrust-producing axis through the spinning of the blades works on the principle of a lifting foil. A foil requires an optimal angle of attack for maximum lift, likewise an optimal pitch angle of the blade is required to have a maximum increase of the thrust-producing water kinetic energy. For a given design of propeller or impeller-driven water jet, it could hardly operate in optimal pitch angle at all vehicle speeds, and that is why a propeller or an impeller-driven water jet can only reach its highest efficiency at the design point. As the vehicle operates at off-deign points, the efficiency of such propulsors degrades greatly. In other words, such propulsors could hardly offer the thrust power that is proportional to the input power. In real life, that fact reflects a poor acceleration of a marine vehicle equipped with such propulsors.

Our forefathers had long before understood that to most effectively propel and offer almost linear propulsion power to his boat one should do what oarsman does commonly seen in boat racings. In one propulsion cycle, oarsman gives a powerful stroke of his oar to expel or discharge the water, which generates a reaction force, i.e., the thrust on the oar surface to push the boat, and then follows an effortless oar recovering stroke through the air. The reason of such a propulsion cycle being highly efficient is that the mechanical work done on the oar to expel the water more or less only accelerates the water velocity in line with the thrust and the oar recovering through the air introduces negligible resistive energy loss. There also exists piston or reciprocating water jet propulsors to propel marine vehicles. From the way of expelling or discharging water, such propulsors work in the same principle of oars. Similarly, the biggest advantage of a piston water jet propulsor is that the mechanical motion of the piston is in line with the thrust-producing axis and therefore such a motion builds up the water kinetic energy only from the water velocity in the thrust-producing axis. Because of this reason, such a propulsor has a nearly constant efficiency at any working condition or vehicle speed. This characteristic of a piston water jet is consistent with the common knowledge that the efficiency of a positive displacement pump is nearly constant and higher than an impeller-driven pump of the same power.

Unlike the oar recovering through air, an issue relating to the efficiency of a piston water jet propulsor is the energy cost in the water intake process during the piston's recovering or back stroke. Prior arts of piston water jet propulsor all employ the water intake from the axial direction of the cylinder as the piston takes a back stroke, for example, through the openings on the piston. With this axial intake, the piston during its recovering stroke moves in a direct headwind of the intake flow, resulting in a large resistance to the piston's motion. The piston's mechanical work to overcome this resistance during the recovering stroke is an energy waste, which negatively affects the efficiency of the propulsor.

OBJECTIVES OF INVENTION

The primary objective of the invention is to achieve that the piston moves in atmospheric air condition during its recovering stroke for water intake, and therefore leads to a negligible energy loss for water intake for a piston water jet propulsor. Another objective is to invent an open-close valve for the Side-Intake of water that makes the piston's recovering stroke through air achievable. A further objective is to achieve an actual design of the Side-Intake Piston Water Jet Propulsor that embodies the principle of the Side-Intake concept. All these achieved objectives results in the invention of a high-efficiency piston water jet propulsor for marine vehicles.

SUMMARY OF THE INVENTION

The current Side-Intake Piston Water Jet Propulsor is characterized by the principle feature of the Side-Intake of water. The principle feature of Side-Intake of water in a piston water jet propulsor is that the piston separates the cylinder into a dry and a wet compartment at any time it moves for water intake and discharge. The dry compartment is always at atmospheric or ambient pressure condition, which allows the piston encounters only air or ambient pressure resistance that consumes a negligible amount of energy during its recovering stroke and water intake.

An efficient, simple and reliable inner-ring rotational valve is invented to achieve the Side-Intake of water for the current propulsion system.

Further more, the principle of the Side-Intake of water together with the inner-ring rotational valve leads to the invention of the current Side-Intake Piston Water Jet Propulsor. Not limited to its advantages in acoustics, simplicity and reliability, the primary advantages of the Side-Intake Piston Water Jet Propulsor particularly include that the propulsor is able to attain unlimitedly to the ideal efficiency of propulsor and offer a linear thrust power because of its feature of a nearly constant efficiency.

DESCRIPTION OF THE FIGURES

The working principle of the Side-Intake concept and the design of the Side-Intake Piston Water Jet Propulsor and their advantages will be well appreciated with the accompanying figures.

FIG. 1-(*b*) is a schematic diagram for a discharge process.

DESCRIPTION OF THE INVENTION

Figure 1:
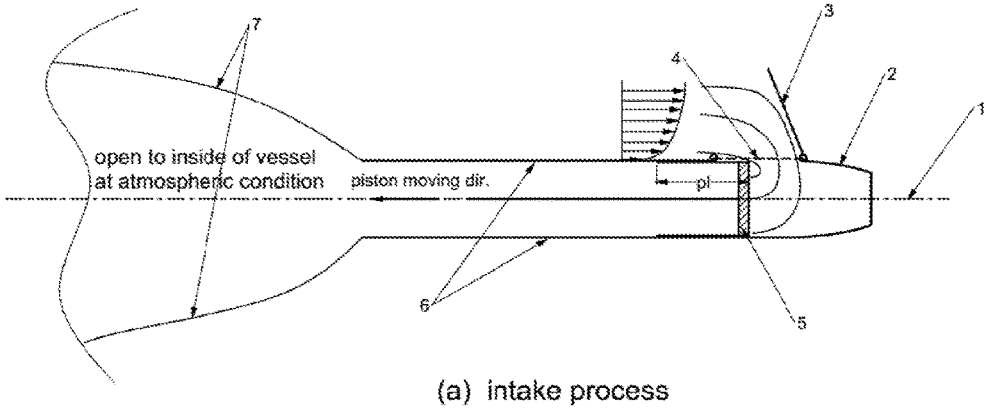
FIG. 1-(*a*) is a schematic diagram for a Side-Intake process.
Figure 1:
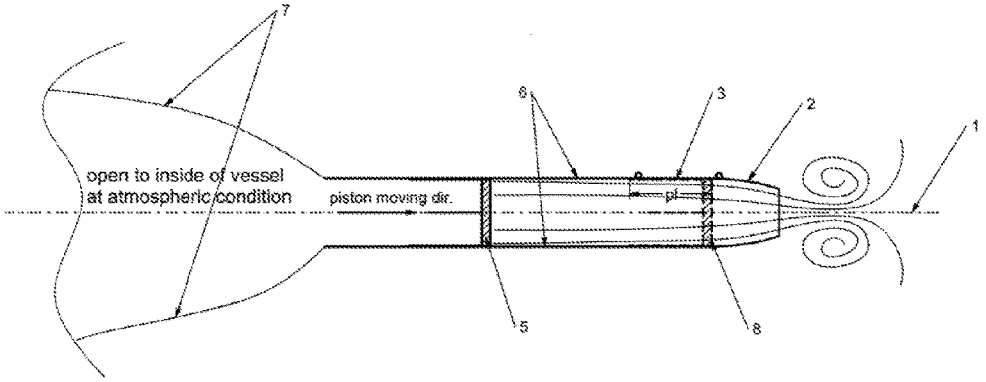
Figure 2:
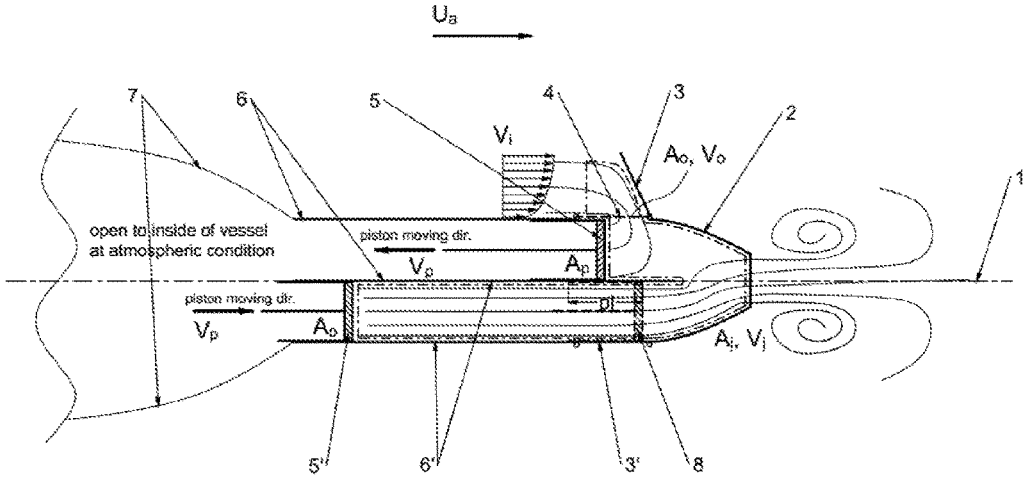
FIG. 2 is a schematic diagram for first principle analysis for a two-cylinder Side-Intake Piston Water Jet Propulsor.

FIGS. 1*a*, 1*b*, and 2 include the following elements, wherein FIG. 2 depicts a double piston assembly:

(1) is the centerline;
(2) is a jet nozzle
(3) is an open-close valve;
(4) is the intake opening;
(5) is a piston;
(6) is the tube/cylinder; and
(7) is the vessel.

1. The Principle of Side-Intake

The concept of Side-Intake of water for a piston water jet propulsor can be shown in a schematic diagram in FIG. 1. First, it requires a tube for a piston to do reciprocating motion inside. The tube could be, but not limited to, a cylinder; however the inventor will refer such a tube to as a cylinder for convenience throughout. The concept of the Side-Intake opens intake holes on the side and near the discharging end of the cylinder wall. An open-close valve must be installed to open and close the Side-Intake holes during the piston's strokes for intake and discharge respectively. The discharge end is completed with a jet nozzle. With a piston installed inside the cylinder, the system becomes a one-cylinder Side-Intake Piston Water Jet Propulsor. FIG. (1)-(*a*) shows the water intake process. In this process, the valve is in fully open position and the piston takes the back (or recovering) stroke, namely the piston moves toward left as shown in the picture. FIG. (1)-(*b*) shows the process of water discharge through the jet nozzle for thrust generation. In this process, the valve is in fully closed position and the piston takes the forward stroke, namely the piston moves toward the right as shown in the picture.

The principle feature for the Side-Intake concept is the separation of the inside of the cylinder to be a dry and a wet compartment by the piston at any moment during piston's motion. This feature can be explained with FIG. 1-(*a*) and -(*b*). As shown in FIG. 1-(*a*) and -(*b*), whether during intake or discharge, the left compartment of the cylinder separated by the piston is always dry and opens to the inside of a vehicle, which is in an atmospheric or ambient pressure condition, and on the other hand the compartment to the right of the piston is always wet containing the water. Because the left compartment of the cylinder is always opens to the atmospheric air or ambient condition, the piston only confronts atmospheric air or ambient pressure during the recovering stroke for water intake, which requires a negligible energy. From hydrodynamic point of view, this characteristic of piston's recovering stroke through air for water intake achieves the same function as an oarsman recovers his oar in the air. However, the current Side-Intake for piston water jet propulsor achieves that under the vehicle's water line.

Following the description of the above, such a piston water jet propulsor, if with just one-cylinder, will have no water intake during the discharge and also no water discharge during the water intake. To keep a continuous water intake and discharge, a Side-Intake Piston Water Jet Propulsor will take at least a pair of cylinders in an actual design.

2. First Principle Analysis

To facilitate an analysis with first principles for a Side-Intake Piston Water Jet Propulsor, a schematic diagram for such a system with two cylinders that could maintain a continuous inflow and jet exit flow is shown in FIG. 2. First principles used in the analysis are the mass, momentum and energy conservation laws in a control volume. The control volume is taken to be the water region enclosed in the dash-dotted line, which is a constant at any moment of the pistons' motion. Neglecting the elevation difference between the intake and discharge as well as water viscous effect, applying the first principles to this control volume leads to, $$\dot{Q}=\rho\cdot A_p\cdot V_p \tag{1}$$

$$T=-\dot{Q}\cdot(V_j-V_i) \tag{2}$$

$$W_p=\dot{Q}\cdot(\tfrac{1}{2}V_j^2-\tfrac{1}{2}U_a^2) \tag{3}$$

$U_a$ is the ambient water velocity, which is the same as the vehicle's speed but in the opposite direction when considering the vehicle is fixed. Equations (1)-(3) govern the mass flow rate, the thrust generation and the piston's net mechanical work added into water. Note that $V_j$ and $V_i$ are in the thrust axis. As it can be seen, the piston's mechanical work of such a system is the work done on the boundary of the control volume and during the piston's recovering stroke for water intake, i.e., the piston moves to the left as shown by the up-piston in FIG. 2, that piston does a negligible amount of work because the left compartment of the piston is always at atmospheric or ambient condition. The useful work is the product of vehicle's speed and the thrust and therefore the efficiency of the propulsor is, $$\eta_{propulsor}=\frac{W_{useful}}{W_p}=\frac{2\cdot U_a}{V_j+V_i}\cdot\frac{V_j^2-V_i^2}{V_j^2-U_a^2} \tag{4}$$

The first factor in the right side of Equation (4) is the well-known ideal efficiency of propeller or water jet. The second factor is considered to be the inflow effect on the propulsor efficiency. Because the area of the intake opening of the valve, $A_o$, will be made larger than the piston area, from the law of mass conservation, $V_i$, will be very close to or even a bit less than $U_a$ if considering the boundary layer ingestion. Thus, the factor of the intake effect of a Side-Intake Piston Water Jet Propulsor could be greater than one and therefore gives a boost to the propulsor efficiency.

The energy equation, Equation (3), for the current Side-Intake Piston Water Jet Propulsor, revealed the fundamental difference from those for the propeller, or the impeller-driven water jet or the axial-intake water jet. For propeller or impeller-driven water jet, the right side of Equation (3) will have an additional term for the water kinetic energy due to water rotational velocities and for the axial-intake piston water jet, the right side of Equation (3) will also have an additional term for the water resistant work on the piston during the intake. These additional and nontrivial energy costs increase the denominator in the efficiency equation, Equation (4) and explained why the prior arts could hardly reach close to the ideal efficiency even though assuming that the prior and current arts could have the same inflow effect.

The first principle analysis showed that the current Side-Intake Piston Water Jet Propulsor is able to achieve the ideal efficiency of propulsor in theory. However, it should be acknowledged that the analysis neglects the energy cost in the open and close of the open-close valve for the intake and discharge. For the current art to surpass the efficiency of prior arts, a nontrivial question is to design an open-close valve that costs the least energy, or at least less than the energy waste in prior arts, during its opening and closing in water. An inner-ring rotational valve is invented and discussed in VIII, which is expected to cost a negligible amount of energy to open and close in water.

The above analysis is based on a steady water jet. In reality, the piston motion is unsteady. Recent studies have proven that the water jet generated from an unsteady piston motion is able to form a vortex ring in the jet exit flow, which engulfs the ambient flow, and results in an additional increase of the axial water momentum. Because of this reason, the vortex ring generated from the water jet of unsteady piston motion will contribute to an additional thrust and therefore a further boost to the propulsor's efficiency.

DESCRIPTION OF THE PREFERRED EMBODIMENT

There are many ways to design open-cloase valves to accomplish the current Side-Intake principle. A primary principle for the design of an open-close valve for the current application is the simplicity and the minimum energy loss during the valve open and close process.

The current design of the Side-Intake Piston Water Jet Propulsor employs an inventive inner-ring rotational valve for open-close actuated by an electric magnetic actuator. The propulsion system is a Side-Intake Piston Water Jet Propulsor with 4 cylinders.

Figure 3:
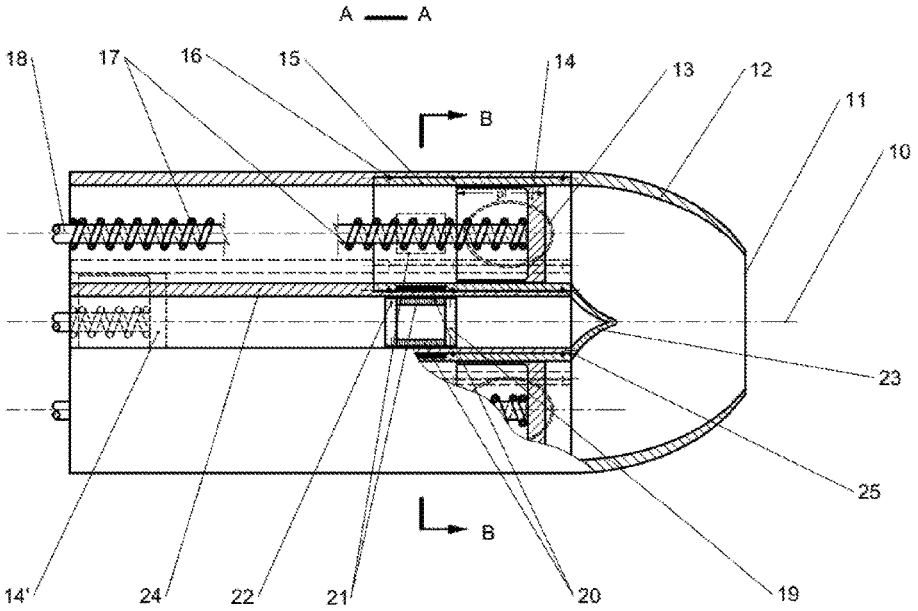
FIG. 3 is a side, break-away view of the Side-Intake Piston Water Jet Propulsor.
Figure 4:
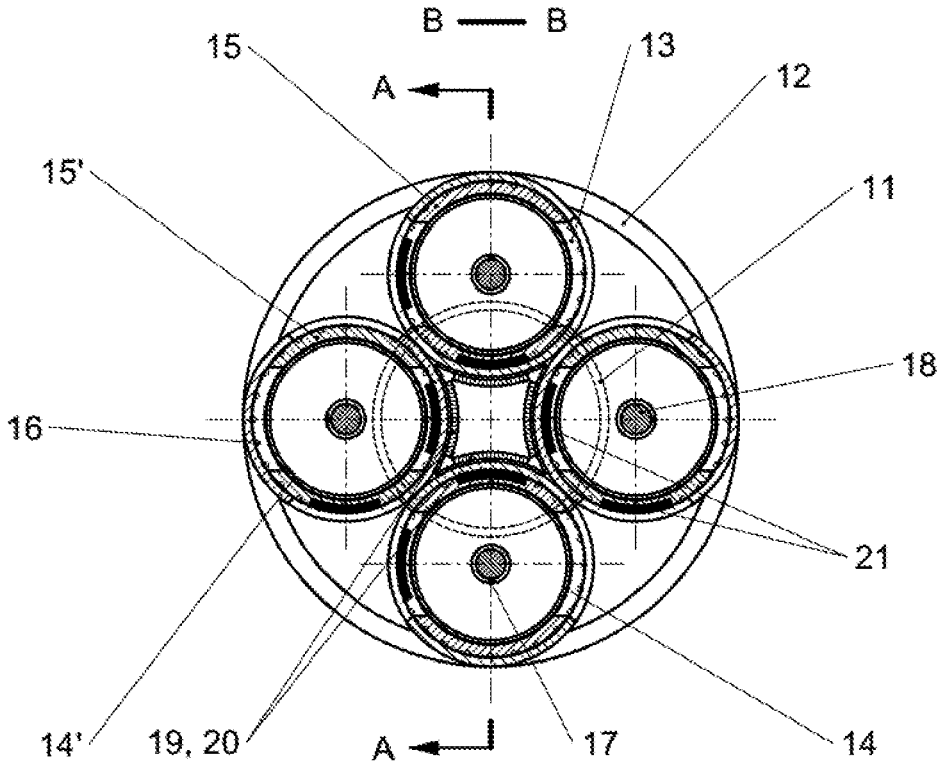
FIG. 4 is a front, break-away view of the Side-Intake Piston Water Jet Propulsor.

In FIGS. 3 and 4., (10) is a centerline;
(11) is an exit;
(12) is the jet nozzle;
(13) is a side intake opening;
(14) are two pistons shown in FIG. 3;
(15) are inner-ring rotational valves;
(16) are the ball bearings;
(17) are the 4 energy absorbing springs, one for each piston;
(18) are piston rods;
(19) is an electric-magnetic actuator;
(20) are coil winding pads installed on the actuator;
(21) are permanent magnetic pads;
(22) are screws; and
(23) is the baffle cap.

For this 4-cylinder Side-Intake Piston Water Jet Propulsor, each two piston-cylinder set is synchronized to move together. For example, one pair of the pistons takes the forward stroke to discharge water from the jet nozzle while the other pair is to take the back stroke to intake water from the Side-Intake openings. This can be seen in both FIG. 3 and FIG. 4. Each inner ring rotational valve has rows of ball bearings for easy rotation and two or four permanent magnet pads embedded in at 90 degree apart along its circumference. The electric-magnetic actuator will make the inner-ring rotational valve to turn 90 degree to open the valve before the intake stroke takes place and turn back or another 90 degree to close the valve before the discharge stroke takes place. The rotational motion to open and close the valve cuts across the flow, which introduces resistive energy loss. However, because the inner-ring is made thin and the cross area for flow cutting is small, the cutting motion of the ring into the flow will, therefore, excite only a little local secondary flow, comparing to a gross secondary flow generation due to the entire blades spin in propeller or impeller-driven water jet. In addition, with the use of ball bearings for easy rotation, the energy cost to open and close the valve is expected to be very small.

As indicated in FIG. 4, at this particular moment, the up- and down-cylinders have the inner-ring rotational valves in fully open position and the two pistons just to start the back stroke for water intake, while the cylinders shown in the left and right have the inner-ring rotational valves in fully closed position and the two pistons just to start the forward stroke for water discharging. Associated with FIG. 4, the pistons' positions can be seen in FIG. 3 at this same moment.

Each spring installed in the dry compartment and attached to the piston is to absorb the potential energy from the water during the intake. Because the air behind the cylinder is at atmospheric or ambient condition and the cylinder is submerged in water at certain depth of water depending on the waterline level of the vehicle, during the water intake the water hydrostatic pressure will do the work on the piston that adds energy into the system and the spring is designed such that to absorb and store that energy. That same amount of energy stored in the spring will then add back into water during piston's discharging stroke. That spring is particularly necessary when the current propulsor is applied to powering deeply-submerged vehicles.

The current propulsor can be applied to powering either surface or underwater vehicles. Prime mover to drive the piston's motion can either come from combustion engines or linear motors. If linear motors are used, then the rods connecting the pistons are not necessary.

What is claimed is:

1. A 4-cylinder Side-Intake piston water jet propulsor for marine vehicles comprising:

four identical 1-cylinder Side-Intake piston water jet propulsors, each 1-cylinder Side-Intake piston water jet propulsor comprising:

a cylinder having a first end and a second end;

one or more intake openings made on and through the cylinder wall and positioned adjacent an open discharge outlet of the cylinder being perpendicular to the cylinder axis, said intake openings constitute an inlet flow coming from side in reference to an outlet flow that is in line with the cylinder axis;

an open-close valve to open and close said one or more openings during the reciprocating movement of a piston for water intake and discharge respectively; and a jet nozzle connected to the outlet of the cylinder; wherein said piston becomes a separation barrier within an interior of said cylinder to create a dry and a wet compartment by said piston during its movement;

wherein the piston is attached to a rod of length such that the rod and piston prevent water from said one or more openings flowing into the dry compartment;

the four identical 1-cylinder Side-Intake piston water jet propulsors being bundled together;

a single jet nozzle shared by the four cylinders for water discharge and is secured with said cylinders;

an inner-ring rotational valve is embedded inside and at a discharge end of each cylinder that has matching openings with the said valve;

one or more ball bearings to ensure free rotation of said valve against the cylinder wall;

an electric-magnetic actuator;

a baffle cap to seal water from reaching the electric magnetic actuator;

a spring installed in the dry compartment of each cylinder and attached to the piston; and the rod of each of the four pistons transfers power from prime mover to the piston, is connected to the piston.

2. Said propulsor of claim 1 wherein the inner ring rotational valve comprising:

a cylindrical ring with two see-through elliptical openings on the ring wall;

one or more magnets embedded on the ring circumferential wall and away from said openings, whereby said electric-magnetic actuator in claim 1 rotates said valve by 90° a time to open and close the valve.

* * * * *